US006359542B1

(12) United States Patent
Widmayer et al.

(10) Patent No.: US 6,359,542 B1
(45) Date of Patent: Mar. 19, 2002

(54) SECUREMENT FOR TRANSFORMER CORE UTILIZED IN A TRANSFORMER POWER SUPPLY MODULE AND METHOD TO ASSEMBLE SAME

(75) Inventors: Robert B. Widmayer, Harvard; James W. Turocy, Arlington Heights, both of IL (US)

(73) Assignee: Motorola, Inc., Schaumburg, IL (US)

( * ) Notice: Subject to any disclaimer, the term of this patent is extended or adjusted under 35 U.S.C. 154(b) by 43 days.

(21) Appl. No.: 09/648,311

(22) Filed: Aug. 25, 2000

(51) Int. Cl.[7] ..... H01F 27/02; H01F 27/26
(52) U.S. Cl. ..... 336/67; 336/92; 336/210
(58) Field of Search ..... 336/92, 210.67, 336/212, 83

(56) References Cited

U.S. PATENT DOCUMENTS

| | | | | |
|---|---|---|---|---|
| 4,364,295 A | * | 12/1982 | Stich | 84/726 |
| 5,337,034 A | * | 8/1994 | Grimes | 336/92 |
| 5,587,652 A | * | 12/1996 | Berkcan et al. | 324/127 |
| 5,598,327 A | * | 1/1997 | Somerville et al. | 363/131 |
| 6,005,773 A | * | 12/1999 | Rozman et al. | 361/707 |
| 6,015,301 A | * | 1/2000 | Brodsky et al. | 439/73 |

* cited by examiner

*Primary Examiner*—Anh Mai

(57) ABSTRACT

An apparatus and method for releasable securement together of a transformer power supply assembly together which includes a stacked arrangement (20) of a first transformer core plate (28) positioned to overlie a circuit board (26), a second transformer core plate (24) positioned to underlie the first transformer core plate (28) and the circuit board (26) and a carrier member (22) positioned beneath the second transformer core plate (24), the first and second transformer core plates (28,24) contact one another through at least one opening positioned in the circuit board (26). The apparatus includes having a body positioned over the first transformer core plate (28) in which the body of the span member (32) extends over a surface of the first transformer core plate (28) and extends from a portion of a peripheral edge of the first transformer core plate (28) to another portion of the peripheral edge of the first transformer core plate (28). A cross member (42) connected to the span member extends in a direction transverse to the span member (32) and is interposed between the span member (32) and the first transformer core plate (28). At least two engagement leg members (38) are provided in which one engagement leg member (38) is connected to the span member (32) and extends in a direction transverse to the span member (32) for extending along a side of the stacked arrangement (20) and another engagement leg member (38) is connected to the span member (32) and is spaced apart from the one engagement leg member (38) and extends transverse to the span member (32) for extending along an opposing side of the stacked arrangement (20). At least two hook members (40) for engaging the carrier (22) in which one hook member (40) is connected to the one engagement leg member (38) and extends in a direction transverse to the one engagement leg (38) member and another hook member (40) is connected to the other engagement leg member (38) and extends in a direction transverse toward the other engagement leg member (38).

28 Claims, 5 Drawing Sheets

SECUREMENT FOR TRANSFORMER CORE UTILIZED IN A TRANSFORMER POWER SUPPLY MODULE AND METHOD TO ASSEMBLE SAME

FIELD OF THE INVENTION

The present invention relates generally to a transformer power supply module and, more particularly to securement of two piece transformer cores within a transformer power supply positioned on a circuit board.

BACKGROUND OF THE INVENTION

Transformer power supply modules are becoming more widely utilized for electronic communication devices such as high power radio bases, as well as for other electronic devices. These transformer power supply modules are mounted to a circuit board.

These transformer power supply modules include transformer core plates that are mounted to a circuit board, which typically carries electronic circuits. The transformer core plates are typically two metallic core plates often constructed of ferrite material. Each core plate is positioned one on each side of the dielectric or ceramic circuit board. The core plates are in contact with each other through an opening provided in the circuit board.

The circuit board in these assemblies is secured to a carrier such that one of the two metallic core plates is positioned interposed between the bottom side of the circuit board and the carrier. The other core plate is positioned overlying the circuit board. Thus, a sandwiched or stacked arrangement is created with a core plate, circuit board, a second core plate and a carrier. Additionally, a heat sink may be secured to the core plate in this stacked arrangement.

It is important that the transformer core plates are secured together to make good contact with one another in the stacked arrangement to insure optimum operation of the transformer. Additionally the core plates need to be maintained in alignment with one another and with the circuit board in a lateral direction. Thus, for proper operation of the transformer, the core plates need to be maintained with a compressive force and lateral restraint.

To secure these two core plates together, typically, a through hole is positioned in each element of the stacked arrangement of the power supply module, including the top core plate, the circuit board, the bottom core plate and the carrier. If a heat sink were positioned on the top core plate, a through hole would be positioned in the heat sink as well. With all of these components having a through hole positioned within them, the components are sandwiched together such that the through holes are in alignment. With the through holes in alignment, a screw or threaded bolt with a nut can be positioned through the through holes securing all of the components together. Alternatively, through holes may be positioned only in the carrier with bolts projecting upward through the holes. A metal clamp having through holes corresponding to the holes in the carrier is then positioned atop the sandwiched components, engaging the upwardly projecting bolts. Nuts may then be applied to the upper ends of the bolts and tightened to force the metal clamp against the sandwiched core plates and circuit board, thus securing these components to the carrier.

As can be appreciated, this bolted stacked arrangement or sandwiched assembly of this transformer power supply is awkward and time consuming to assemble. The core plates must be positioned on either side of the circuit board. The through holes of all of the components including the circuit board, the plates, the carrier and even possibly a heat sink, must be placed in registration with one another in order to engage the through holes of all of the components with a screw or bolt.

This construction makes it also difficult to test the core plates before they are installed into operation. The core plates which are positioned on either side of the circuit board are not easily maintained in alignment and secured contact with one another and must be temporarily secured together for testing prior to installation to a heat sink platform. Typically, a clamp, tape or glue would be needed to temporarily secure the top core plate, the circuit board and the bottom core plate together in order to test the core assembly. During testing, the components of the assembly must be maintained in lateral alignment and secured compressively together. After the testing, the assembly would have to be disassembled and the process of aligning and securing the components together would be repeated prior to operational use in the field.

Moreover, the individual pieces of this stacked arrangement of the power assembly module make it difficult for the field technicians to replace or install the assembly in the field. After the transformer plate cores have been removed from the circuit board, the field technician would find it awkward to position the two new core plates on opposing sides of the circuit board with the carrier heat sink platform positioned below the second plate and then align the all of these components including their respective through holes prior to securing them together with passing a screw or bolt through the through holes.

It is clear that, transformer power supply modules are awkward and difficult to assemble, test and utilize as a field replacement part. One generally needs to maintain the transformer core plates in alignment with one another on either side of the circuit board in alignment with the circuit board and maintain them in compressive contact with one another for optimal operation of the power supply module. In testing the core plates, the core plates likewise need to be compressively secured together on either side of a circuit board and maintained in lateral alignment for proper testing when testing them apart from an operational field unit. In addition, the core plates must be easily installed with compressive and lateral securement in the field for them to be used as replacement components in a field unit. Aligning through holes of multiple components can be tedious, time consuming and difficult, for assembling, testing and using as replacement components.

Additionally, the lateral alignment and restraint of the two core plates is critical when projections interposed between the core plates make electrical connection therebetween. With multiple projections involved, to make contact with the core plates, tolerances of fabrication are of concern in both plate constructions. Failure to make good contact with the other core plate will result in improper performance of the transformer. The inadequacies that may be created by inaccurate tolerances of the projections are not compensated for with a rigid securement of a clamp or screw or bolt used to connect the core plates together.

Thus, a need exists for an improved securement of the core plates of the transformer power transformer module. The improved securement must accommodate ease in assembly of the core plates to the circuit board, ease in testing the power module before sending it to the field and ease in installation for purposes of use in connection as a field replacement part. Moreover, the securement must assist in providing good contact between the core plates where the tolerances in the fabrication of the plates have not been precisely maintained.

BRIEF DESCRIPTION OF THE DRAWINGS

The foregoing objects and advantageous features of the invention will be explained in greater detail and others will be made apparent from the detailed description of the present invention, which is given reference to the several figures of the drawing, in which.

DETAILED DESCRIPTION OF THE DRAWINGS

Generally, the present invention encompasses a clamp securement member that exerts a compressive force between two transformer core plates enhancing contact between the two core plates, in a direction perpendicular to a plane generally formed by the two core plates or referred to as a "z" direction. In addition, the clamp securement member exerts a force against at least one of the core plates in at least one of two directions in the plane generally formed by the two core plates or referred to as "x" and "y" directions.

Figure 1:
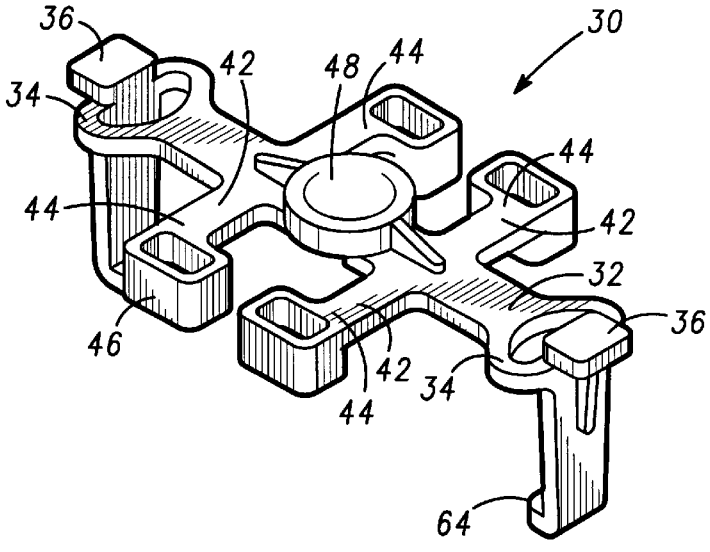
FIG. 1 is a top perspective view of the securement member of the present invention.
Figure 2:
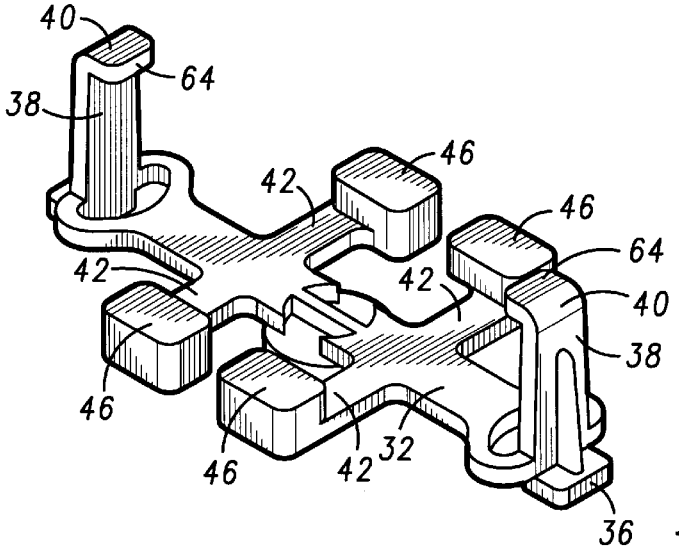
FIG. 2 is a bottom perspective view of the securement member shown in FIG. 1.

FIGS. 1 and 2 show, in detail, an embodiment of the securement member of the present invention. Securement member 30 comprises a span member 32 having a pair of opposite ends 34, and an elongated body extending between opposite ends 34. Span member 32 is constructed from a flexible resilient material. A finger pad 48 is located on span member 32 intermediate opposite ends 34 of the span member. An extension member 36 also projects from each end 34 of span member 32 generally along the plane defined by span member 32. The utilization of extension members 36 and finger pad 48 will be discussed in more detail below in conjunction with grasping and securing securement member 30 to the transformer power supply module, as seen in FIGS. 4–10.

As seen in FIGS. 1 and 2, an engagement leg member 38 extends from a corresponding end 34 of span member 32 and may be integrally formed with span member 32. Each of engagement leg members 38 terminates in a hook member 40. Each hook member 40 may be integrally formed with its respective engagement leg member 38. Also, each hook member 40 includes a hook member end 64, hook member ends 64 projecting toward one another in a direction generally parallel to a plane defined by span member 32.

A pair of cross members 42, as seen in FIGS. 1 and 2, are connected to span member 32 along its body. Cross members 42 extend in a direction transverse to span member 32. Each cross member 42 is constructed of a flexible resilient material. Cross members 42, as shown, are integrally formed with span member 32. Each cross member 42 has a pair of opposite ends 44. A foot member 46 is located at each of cross member opposite ends 44. Foot members 46 extend below the plane defined by span member 32 so as to be interposed between span member 32 and first transformer core plate 28, as can be seen in FIGS. 7–10, effectively spacing span member 32 from first transformer core plate 28.

Figure 3:
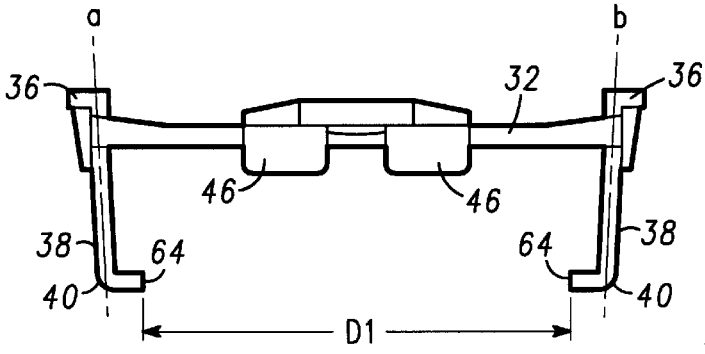
FIG. 3 is a side view of the securement member shown in FIG. 1.

Referring to FIG. 3, an engagement leg member 38 extends from each of a corresponding span member end 34 along a line in a predetermined direction. In the first embodiment, the directions of the lines "a" and "b" along which engagement leg members 38 extend are oriented so as to converge. Engagement leg members 38 may be integrally formed with span member 32. As seen in FIG. 3, engagement leg members 38 are in a relaxed or undeflected state. In the relaxed state of engagement leg members 38, hook member ends 64 are spaced apart at a distance D1. This relaxed or undeflected state of engagement leg members 38 will be discussed in more detail below.

Figure 4:
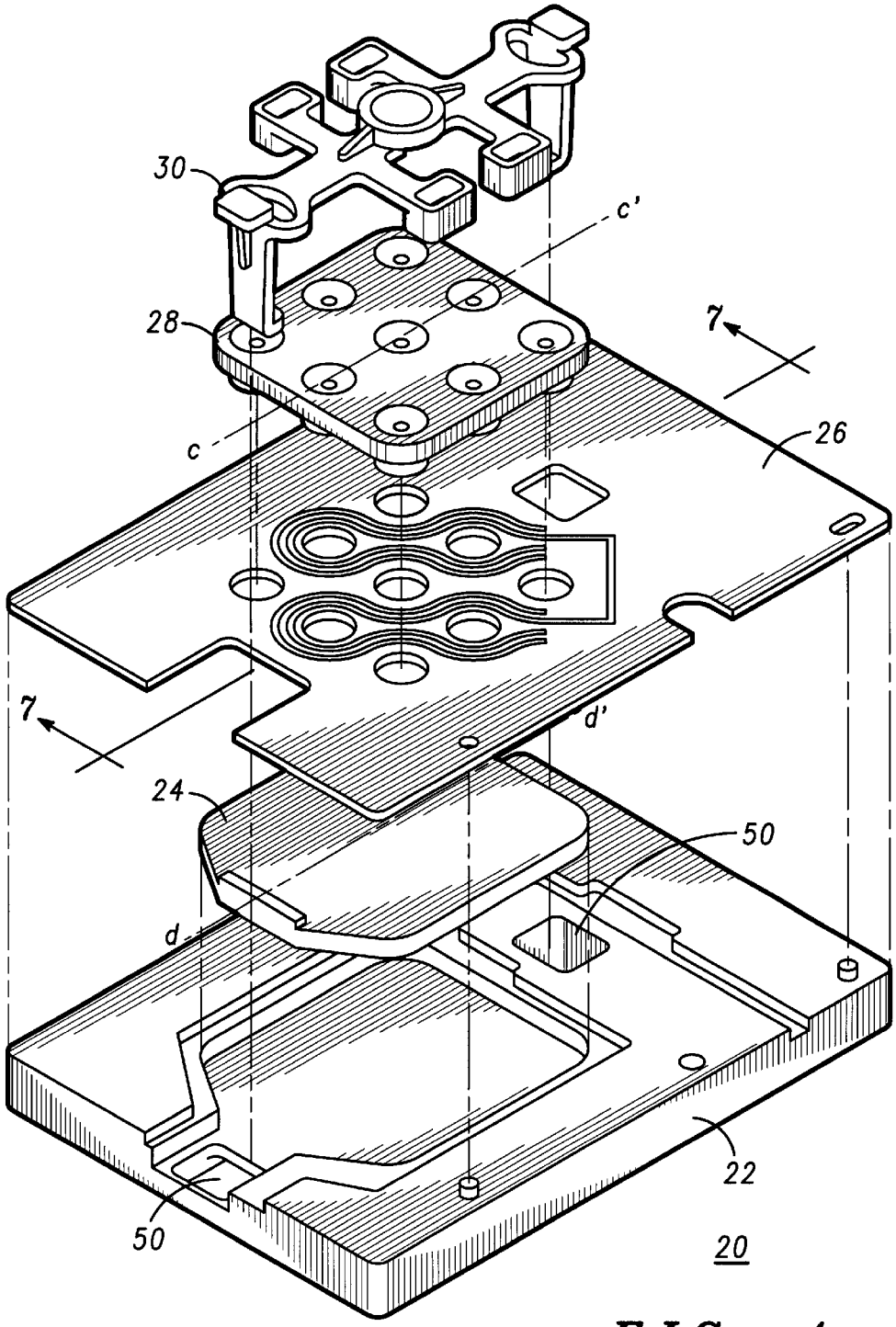
FIG. 4 is an exploded perspective view of the stacked arrangement of the power transformer module showing the securement member of FIG. 1.

FIG. 4 shows a stacked arrangement 20 of a transformer power supply module incorporating one embodiment of the securement member of the present invention. The stacked arrangement 20 of the transformer power supply module includes a first transformer core plate 28, a circuit board 26, a second transformer core plate 24 and a carrier 22. All of these constituents of the stacked arrangement are secured to a carrier 22 by securement member 30. First transformer core plate 28 has an axis of symmetry c–c', while second transformer core plate 24 has an axis of symmetry d–d'. To assemble stacked arrangement 20, second transformer core plate 24 is positioned on carrier 22. Circuit board 26 is then positioned atop second transformer core plate 24, and first transformer core plate 28 is positioned atop circuit board 26. Securement member 30 is then positioned atop first transformer core plate 28 and secured to carrier 22 in a manner to be described. As seen in FIG. 4, a pair of leg member receiving cavities 50 are incorporated into carrier 22 for receiving insertion of engagement leg members 38 during operation of the securement member. Each leg member receiving cavity 50 incorporates a hook end receiving shoulder 52 for engaging one of hook member ends 64 when securement member 30 is applied to stacked arrangement 20.

Figure 5:
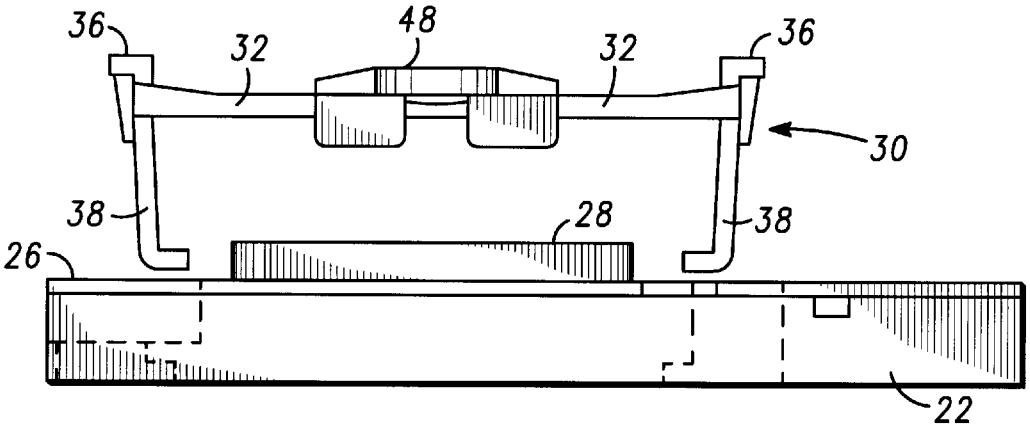
FIG. 5 is a side view of the power transformer module showing the module partially assembled, with the securement member positioned just above the circuit board.

Referring to FIG. 5, securement member 30 is positioned over stacked arrangement 20 prior to engagement. Preferably, span member 32 is positioned to overlie an axis of symmetry c–c' of first transformer core plate 28, as seen in FIG. 4, as well as an axis of symmetry d–d' of second transformer core plate 24. Generally, axes of symmetry c–c' and d–d' are substantially aligned when core plates 24, 28 are stacked over one another, as seen in FIG. 4. Both core plates 24, 28 are preferably of substantially the same dimensions and shape.

Figure 6:
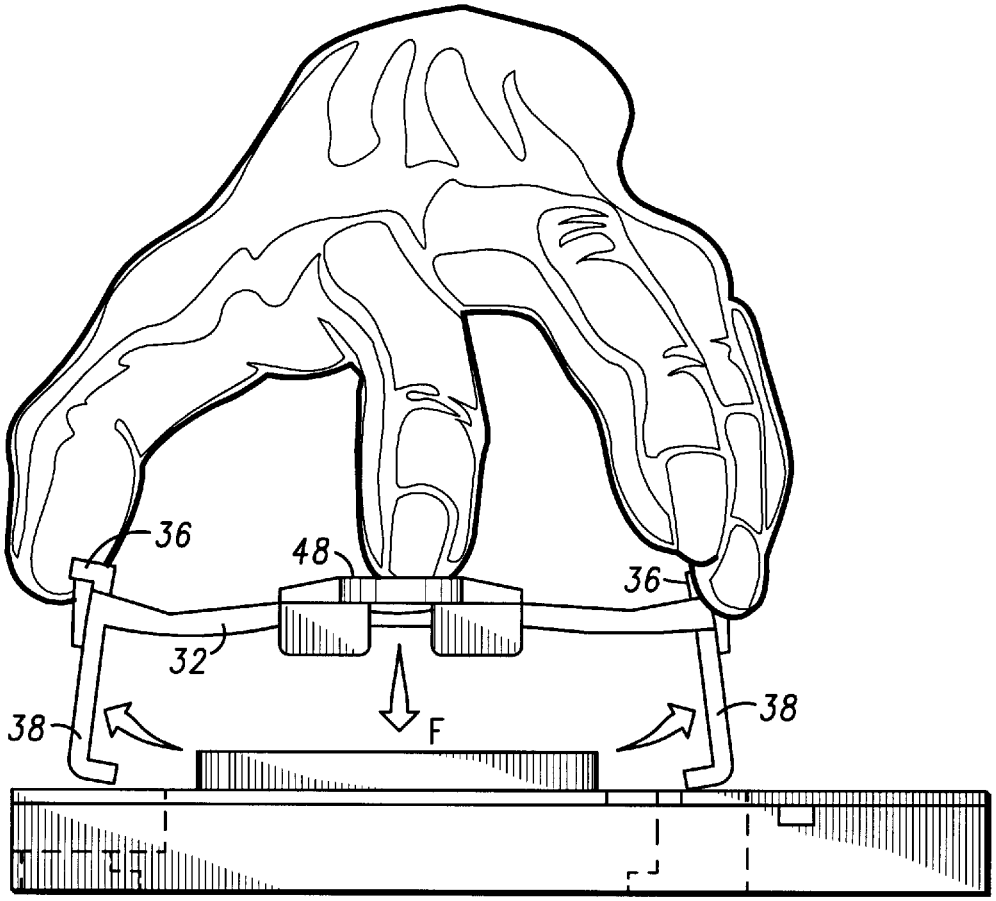
FIG. 6 is a side view of FIG. 5 with the engagement leg members deflected outward to provide clearance on opposing sides of the stacked arrangement of the power transformer module.

Operation of securement member 30 is shown in FIGS. 6–10. Referring to FIG. 6, securement member 30 is actuated by gripping the securement member between two opposed fingers of a user at extension members 36 residing at opposite ends 34 of span member 32. The index finger of the user is then used to apply a force against finger pad 48 in the direction of arrow F. Application of this downward force while gripping the span member between opposed fingers at extension members 36 causes engagement leg members 38 to deflect outward as indicated by the arrows in FIG. 6. With engagement leg members 38 deflected outward, securement member 30 is lowered toward stacked arrangement 20.

Figure 7:
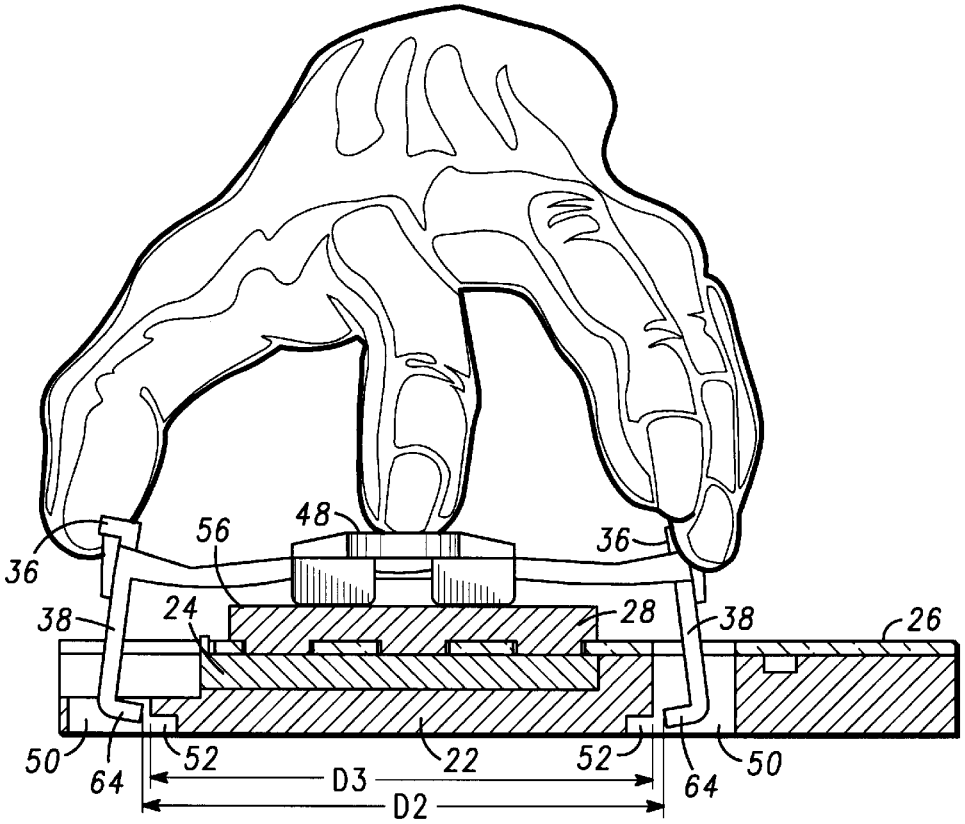
FIG. 7 is a cross-section view of the power transformer module along line 7—7 of FIG. 4 showing the securement member resting on the top core plate of the stacked arrangement and positioned to engage the carrier.

Referring to FIG. 7, when engagement leg members 38 are deflected outward, the distance D2 between hook member ends 64 increases until the distance separating hook member ends 64 exceeds the distance D3 between opposite sides of stacked arrangement 20. When the distance D2 separating hook member ends 64 exceeds distance D3, adequate clearance exists between the opposite sides of stacked arrangement 20 and hook member ends 64 such that hook member ends 64 can be inserted past the opposing sides of stacked arrangement 20 into leg member receiving cavities 50. As seen in FIG. 7, securement member 30 is lowered toward stacked arrangement 20 until foot members 46 rest on an upper surface 56 of first transformer core plate 28. When foot members 46 rest on upper surface 56, span member 32 is suspended above first transformer core plate 28 by its attachment to cross members 42, which extend across span member 32 and which are supported at their ends by foot members 46.

Figure 8:
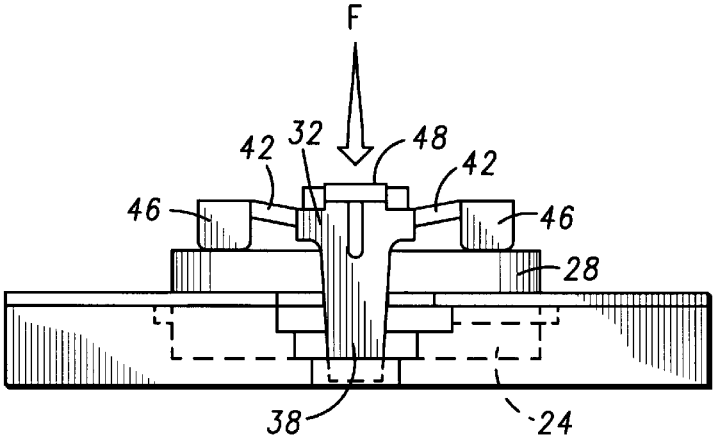
FIG. 8 is a front view of the power transformer module of FIG. 4 showing the securement member resting on the top core plate of the stacked arrangement and positioned to engage the carrier.

Referring to FIG. 8, additional pressure is then applied by the index finger of the user to finger pad 48 in the direction of arrow F, forcing span member 32 toward first transformer core plate 28 and causing portions of cross members 42 proximate span member 32 to deflect toward first transformer core plate 28.

Figure 9:
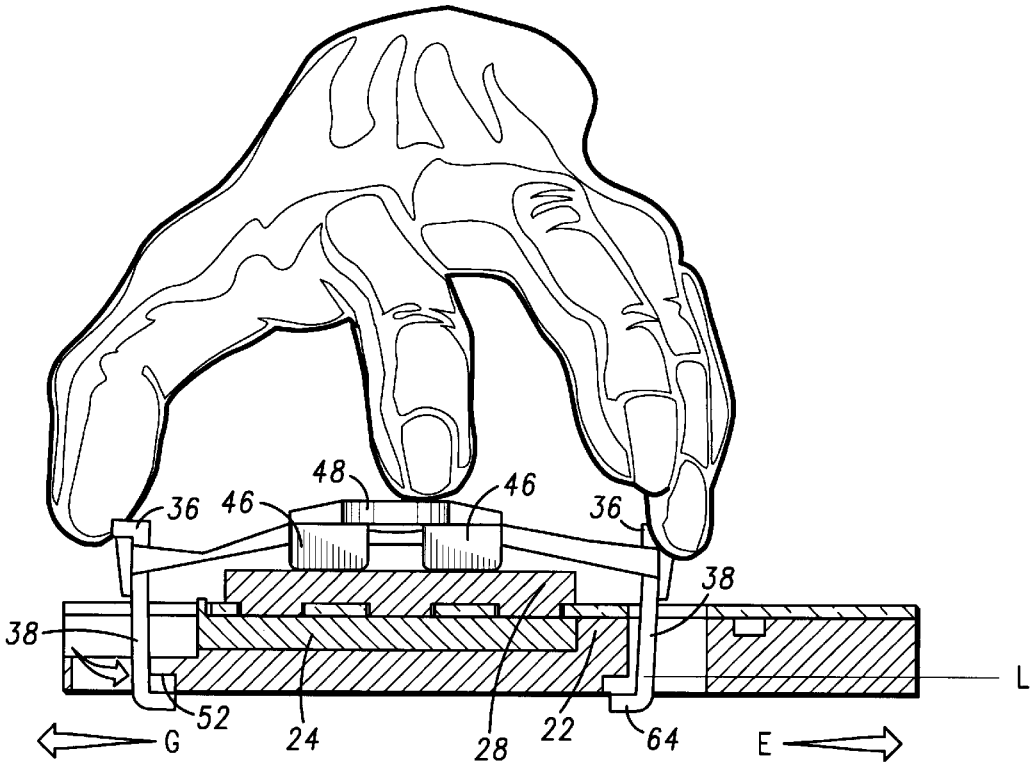
FIG. 9 is the view of FIG. 7 showing the relationship between the securement member and the stacked arrangement prior to engagement of the securement member and the carrier.

Referring to FIG. 9, as span member 32 is forced toward first transformer core plate 28, engagement leg members 38 attached to span member ends 34 are forced farther into leg member receiving cavities 50, bringing hook member ends 64 below the line "L" designating the level where hook end receiving shoulders 52 reside. When the forces applied by the opposing fingers of the user on extension members 36 are removed, engagement leg members 38 will tend toward their undeflected states as indicated by the arrows in FIG. 9, permitting hook member ends 64 to overlap hook end receiving shoulders 52. However, after the forces on extension members 36 are removed, engagement leg members 38 do not return to a completely undeflected state, engagement leg members 38 instead coming to rest against the opposing sides of stacked arrangement 20, effectively laterally biasing stacked arrangement 20 and, in this example, second core plate 28 in the direction of arrow E, toward one side of carrier 22, while the opposing engagement leg member 38 biases in a direction of arrow G against carrier 22. It can be appreciated that engagement leg member 38 against any number of the stacked arrangement 20 components depending on the particular design of the power transformer module. Moreover, it can be further appreciated that additional engagement leg members 38 can be added to securement member 30 in a direction transverse to the alignment of engagement leg members 38 shown in order to restrain and/or secure stacked arrangement 20 in both the "x" and "y" directions.

Figure 10:
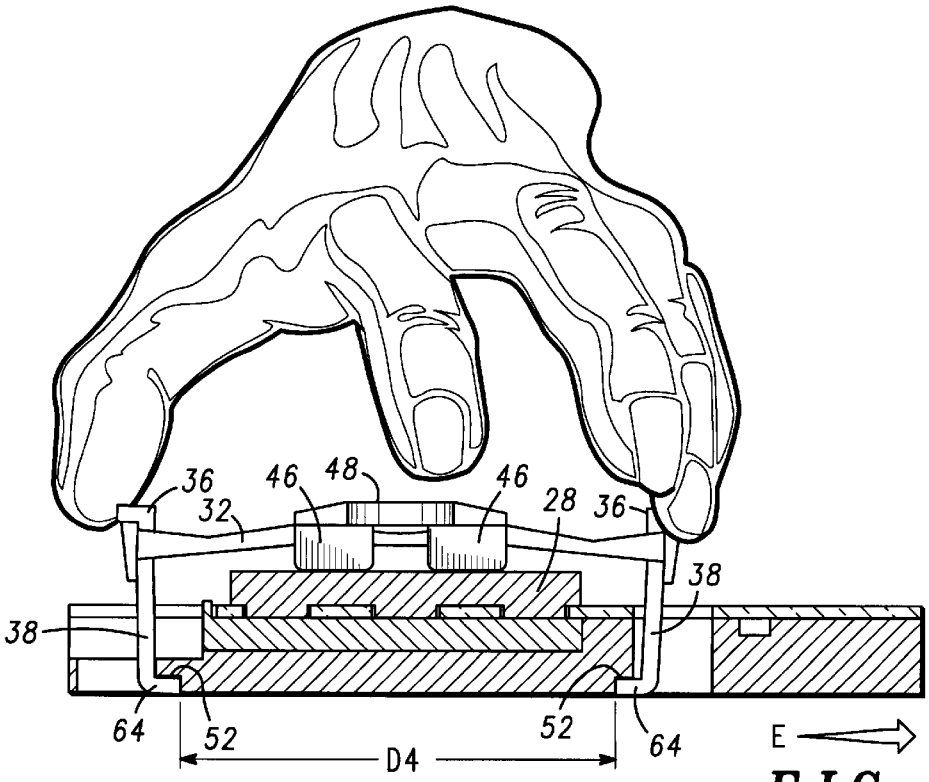
FIG. 10 is the view of FIG. 7 with the securement member fully engaged to the stacked arrangement including the carrier of the power transformer module.

Referring to FIG. 10, after the forces on extension members 36 are removed, the pressure applied by the user's index finger on finger pad 48 is then removed, causing cross members 42 to tend toward their relaxed or undeflected states and tending to force span member 32 upward, away from first transformer core plate 28 until hook member ends 64 engage hook end receiving shoulders 52. However, hook member ends 64 will engage hook end receiving shoulders 52 before cross members 42 have returned to their completely relaxed or undeflected states provided by the predetermined shortness in length of engagement leg members 38. Thus, foot members 46 will remain biased against upper surface 56 of first transformer core plate 28 after pressure on finger pad 48 is removed and, in turn, pushes first core plate 28 into second core plate 24 and second core plate 24 into carrier 22. At this point, securement member 30 is fully engaged to secure the components of stacked arrangement 20 together.

The biasing forces exerted by securement member 30, both downward toward carrier 22 and laterally toward one side of carrier 22, act to immobilize the elements of stacked arrangement 20, helping to prevent relative movement between these elements which may lead to misalignment of the elements. Moreover, the resilient biasing by the construction of securement member 30 and, particularly, in the z direction, will assist in overcoming deficiencies in tolerances in the construction of core plates 24, 28.

To disengage securement member 30, the procedure described above is reversed. Pressure is applied to finger pad 48 by the index finger of the user in the direction of arrow F (FIG. 8), causing deflection of cross members 42 toward first core plate 28, thereby moving engagement lag members 38 downward and enabling hook member ends 64 to disengage from hook end receiving shoulders 52. Securement member 30 is then gripped between two opposing fingers of a user at extension members 36. Extension members 36 are forced in a direction away from first transformer core plate 28 while pressure is maintained on finger pad 48, causing leg members 38 and hook members 40 to deflect outward, away from the opposing sides of stacked arrangement 20, thereby providing a clearance between each of hook member ends 64 and the corresponding sides of stacked arrangement 20. Engagement leg members 38 can then be withdrawn from leg member receiving cavities 50.

As seen from the description above, the securement member of the present invention provides important advantages over existing methods of securing transformer cores within a transformer power supply positioned on a circuit board. Installation and field replacement of the transformer power supply module using the securement member of the present invention is easier and less time consuming than when existing assembly methods are used. Also, testing of the transformer cores prior to installation for actual service is expedited by the relative ease with which the plates can be aligned and secured to one another. In addition, by enabling application of biasing forces in at least two planes, the securement member of the present invention aids in preventing misalignment between elements of the stacked arrangement after the stacked arrangement has been assembled and provides a biasing force to facilitate good contact between core plates which have not been constructed in an otherwise necessary tolerance.

While a detailed description of various embodiments of the present invention have been given, it should be appreciated that many variations can be made thereto without departing from the scope of the invention as set forth in the appended claims.

What is claimed is:

1. A releasable securement apparatus for releasably securing a transformer power supply assembly together which includes a stacked arrangement of a first transformer core plate positioned to overlie a circuit board, a second transformer core plate positioned to underlie the first transformer core plate and the circuit board, and a carrier member positioned beneath the second transformer core plate, the first and second transformer core plates contact one another through at least one opening positioned in the circuit board, comprising:

a span member having a body positioned over the first transformer core plate in which the body of the span member extends over a surface of the first transformer core plate and extends from a portion of a peripheral edge of the first transformer core plate to another portion of the peripheral edge of the first transformer core plate;

a cross member connected to the span member in which the cross member extends in a direction transverse to the span member, the cross member is interposed between the span member and the first transformer core plate;

at least two engagement leg members in which one engagement leg member is connected to the span member and extends in a direction transverse to the span member for extending along a side of the stacked arrangement and another engagement leg member is connected to the span member and is spaced apart from the one engagement member and extends transverse to the span member for extending along an opposing side of the stacked arrangement; and at least two hook members for engaging the carrier in which one hook member is connected to the one engagement leg member and extends in a direction transverse to the one engagement leg member, another hook member is connected to the other engagement leg member and extends in a direction transverse to the other engagement leg member.

2. The releasable securement apparatus of claim 1 in which the body of the span member is elongated.

3. The releasable securement apparatus of claim 1 in which the portion of the peripheral edge of the first transformer core plate is positioned on one side of the first transformer core plate and the other portion of the peripheral edge of the first transformer core plate is positioned on an opposite side of the first transformer core plate.

4. The releasable securement apparatus of claim 1 in which the body of the span member generally overlies at least one axis of symmetry of the first transformer core plate.

5. The releasable securement apparatus of claim 4 in which the second transformer core plate has another peripheral edge which defines substantially the same dimensions and shape as the peripheral edge of the first transformer core plate.

6. The releasable securement apparatus of claim 4 in which the second transformer core plate has an at least one of another axis of symmetry which underlies and is generally in alignment with the at least one axis of symmetry of the first transformer core plate and the body of the span member.

7. The releasable securement apparatus of claim 1 in which the span member is constructed of a flexible material.

8. The releasable securement apparatus of claim 7 in which one of the two engagement leg members extends in a direction along a line and the other of the two engagement leg members extends in another direction along another line, in which the directions of the one and the other lines are oriented to converge.

9. The releasable securement apparatus of claim 8 in which respective ends of the one and the other hook members are positioned at a distance apart from one another less than the distance between a side of the stacked arrangement.

10. The releasable securement apparatus of claim 9 in which the body of the span member has an end and an opposing end upon which a force is applied to both the end and an opposing end of the span member enabling the span member to flex and increase a distance between the spaced apart one and another engagement leg members and enabling the one and other hook members to separate to a distance to exceed the distance between one side of the stacked arrangement and an opposing side of the stacked arrangement enabling the one and other hook members to have clearance along the side and the opposing side of the stacked arrangement.

11. The releasable securement apparatus of claim 7 including an extension member positioned at the one end of the span member and another extension member positioned on an opposing end of the body of the span member enabling prehensile application of force at the one end and opposing end of the span member for flexing the span member.

12. The releasable securement apparatus of claim 11 including a finger pad secured to the span member between the one and opposing ends of the span member for receiving a fingertip for applying a force to the span member.

13. The releasable securement apparatus of claim 1 in which the cross member is constructed of a flexible material.

14. The releasable securement apparatus of claim 1 in which the cross member includes an elongated body.

15. The releasable securement apparatus of claim 1 in which the cross member extends generally within a plane containing the body of the span member.

16. The releasable securement apparatus of claim 13 in which the cross member has one end positioned spaced apart from the body of the span member and another end spaced apart from the span member in which an one foot member is secured to one end of the cross member and another foot member is secured to the other end of the cross member in which the one foot member and the other foot member each extend in a direction transverse to the cross member for engaging the surface of the first transformer core positioning the span member spaced apart from the surface of the first transformer core plate.

17. The releasable securement apparatus of claim 13 include s at least two cross members spaced apart from each other along the span member and extending generally in the same direction.

18. The releasable securement apparatus of claim 16 in which at least one of the two engagement leg members with the respective hook member secured thereto extends short of the carrier of the stacked arrangement with each of the one and other foot members engaged with the surface of the first transformer core plate and the cross member unflexed relative to the span member.

19. The releasable securement apparatus of claim 18 in which the one and other foot members are biased against the surface of the first transformer plate pushing the first transformer core plate against the second transformer core plate with the at least two hook members engaged to the carrier of the stacked arrangement and the cross member flexed relative to the span member.

20. The releasable securement apparatus of claim 19 in which the distance between the respective ends of the two hook members engaged to the carrier of the stacked arrangement is greater than the distance between the hook members without the span member in an unflexed position biasing the two engagement leg members and hook members toward the stacked arrangement.

21. The releasable securement apparatus of claim 1 in which the span member and the cross member are integrally formed.

22. The releasable securement apparatus of claim 1 in which the at least two engagement leg members are integrally formed with the span member.

23. The releasable securement apparatus of claim 1 in which one of the at least two hook members is integrally formed with one of the at least two engagement leg members and another of the at least two hook members is integrally formed with another of the at least two engagement leg members.

24. A method for releasably securing a transformer power supply assembly together which includes a stacked arrangement of a first transformer core plate positioned to overlie a circuit board, a second transformer core plate positioned to underlie the first transformer core plate and the circuit board, and a carrier member positioned beneath the second transformer core plate, the first and second transformer core plates contact one another through at least one opening positioned in the circuit board, including the steps of:

aligning a releasable securement apparatus with the stacked arrangement including positioning a span member of the apparatus to overlie the first transformer core plate and positioning each of at least two engagement leg members connected to opposing sides of the span member and which are in converging alignment with one another and in which a hook member is secured to each of the leg members in which the distance between the hook members is shorter than the distance between opposing sides of the stacked arrangement;

applying a force to the span member flexing the span member and increasing the distance between the hook members providing clearance of the hook members along the opposing sides of the stacked arrangement;

moving the engagement leg members along opposing sides of the stacked arrangement with at least one foot member secured to at least one cross member which is secured transverse to the span member and in which the at least one foot member is interposed between the span member and the surface of the top core plate member until the at least one foot member is positioned resting on the top core plate and the hook members are positioned short of an engagement position of the carrier; and applying another force to the span member flexing the cross member relative to the span member moving the leg engagement members further along the opposing sides of the stacked arrangement until the hook members reach the engagement position of the carrier; and releasing the application of the other force to the span member with the hook members engaging the engagement position of the carrier member maintaining the cross member in a flexed position biasing the at least one foot member against the top core plate and the second core plate with at least one of the leg engagement members biased against at least one of the opposing sides of the stacked arrangement.

25. The method of claim 24 in which the step of applying the force to the span member includes grasping opposing ends of the span member and applying a force to each end moving the opposing ends closer together.

26. The method of claim 25 in which the step of applying the force includes positioning a finger on a mid-portion of the span member to apply a force in an opposite direction than the force applied to the opposing ends of the span member.

27. The method of claim 24 in which the step of applying another force to the span member includes pushing the span member towards the first transformer core plate.

28. The method of claim 24 in which the reapplication of the force to the span member moves the leg engagement members further apart and increases the distance between the hook members allowing the hook members to disengage from the engagement position of the carrier.

* * * * *